US011294315B2

(12) United States Patent
Kudo et al.

(10) Patent No.: US 11,294,315 B2
(45) Date of Patent: Apr. 5, 2022

(54) IMAGE FORMING APPARATUS OPERABLE IN MODES HAVING DIFFERENT COLOR GAMUTS

(71) Applicant: CANON KABUSHIKI KAISHA, Tokyo (JP)

(72) Inventors: Yoshiki Kudo, Mishima (JP); Masaki Shimomura, Suntou-gun (JP); Akihiko Uchiyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/098,849

(22) Filed: Nov. 16, 2020

(65) Prior Publication Data

US 2021/0063937 A1 Mar. 4, 2021

Related U.S. Application Data

(60) Continuation of application No. 16/819,390, filed on Mar. 16, 2020, now Pat. No. 10,866,554, which is a division of application No. 16/030,081, filed on Jul. 9, 2018, now Pat. No. 10,642,209.

(30) Foreign Application Priority Data

Jul. 13, 2017 (JP) ..... JP2017-137195

(51) Int. Cl.
*G03G 15/00* (2006.01)
*G03G 15/01* (2006.01)

(52) U.S. Cl.
CPC ..... *G03G 15/556* (2013.01); *G03G 15/01* (2013.01); *G03G 15/0131* (2013.01); (Continued)

(58) Field of Classification Search
CPC .. G03G 15/01; G03G 15/065; G03G 15/5008; G03G 15/5058; G03G 15/556;
(Continued)

(56) References Cited

U.S. PATENT DOCUMENTS 5,710,824 A 1/1998 Mongeon
7,317,889 B2 1/2008 Suzuki
(Continued)

FOREIGN PATENT DOCUMENTS

JP 62-98373 A 5/1987
JP 08-227222 A 9/1996
(Continued)

OTHER PUBLICATIONS

Office Action dated Jun. 15, 2021, in Japanese Patent Application No. 2017-137195.

*Primary Examiner* — Robert B Beatty
(74) *Attorney, Agent, or Firm* — Venable LLP

(57) ABSTRACT

An image forming apparatus includes a developing roller configured to develop an electrostatic latent image on a photosensitive drum to form a toner image; a belt onto which the toner image is transferred; a detection unit configured to detect a density of an image for detection formed on the belt; and a controller configured to perform hue adjustment based on a detection result of the detection unit. The image forming apparatus performs image formation in a second mode using a color gamut different from a color gamut in a first mode, and the controller obtains a lookup table, which indicates a correlation between image data to be used and input image data in the second mode, based on the detection result in the first mode and a correlation of density between the first mode and the second mode.

14 Claims, 12 Drawing Sheets

(52) U.S. Cl.
CPC ..... *G03G 15/5058* (2013.01); *G03G 2215/00042* (2013.01); *G03G 2215/00059* (2013.01); *G03G 2215/00063* (2013.01)

(58) Field of Classification Search
CPC ..... G03G 15/5054; G03G 2215/00059; G03G 2215/00063; G03G 2215/00042; B41J 2/525; G06K 15/129
See application file for complete search history.

(56) References Cited

U.S. PATENT DOCUMENTS

| | | | |
|---|---|---|---|
| 8,144,365 | B2 | 3/2012 | Kita et al. |
| 9,083,923 | B2 | 7/2015 | Tanaka |
| 9,894,248 | B2 | 2/2018 | Hirano |
| 10,018,951 | B2 | 7/2018 | Saito et al. |
| 10,036,977 | B2 | 7/2018 | Ono |
| 10,168,633 | B2 | 1/2019 | Nakahara et al. |
| 10,539,907 | B2 | 1/2020 | Shimomura et al. |
| 2009/0073469 | A1 | 3/2009 | Kita et al. |
| 2017/0242386 | A1 | 8/2017 | Hirata et al. |
| 2017/0277056 | A1 | 9/2017 | Nakahara et al. |
| 2017/0277068 | A1 | 9/2017 | Naito et al. |
| 2017/0285546 | A1 | 10/2017 | Saito et al. |
| 2017/0371262 | A1 | 12/2017 | Uchiyama |
| 2019/0011849 | A1 | 1/2019 | Funatani |

FOREIGN PATENT DOCUMENTS

| | | | |
|---|---|---|---|
| JP | 09-185208 | A | 7/1997 |
| JP | 2005-043445 | A | 2/2005 |
| JP | 2006-119415 | A | 5/2006 |
| JP | 2006-171245 | A | 6/2006 |
| JP | 2007-304523 | A | 11/2007 |
| JP | 2009-069606 | A | 4/2009 |
| JP | 2011-253067 | A | 12/2011 |
| JP | 2014-165774 | A | 9/2014 |
| JP | 2016-109951 | A | 6/2016 |
| JP | 2017-173466 | A | 9/2017 |

IMAGE FORMING APPARATUS OPERABLE IN MODES HAVING DIFFERENT COLOR GAMUTS

BACKGROUND OF THE INVENTION

Field of the Invention

The present invention relates to an image forming apparatus, and more particularly, to an image forming apparatus having a variable density image formation mode of controlling a supply amount of developer to be supplied to an image bearing member by a developer supply member.

Description of the Related Art

There is a color gamut as one of the image quality indices for an image forming apparatus. The color gamut for the image forming apparatus refers to a color reproduction range of colors that can be output by the image forming apparatus, and a wider color gamut means a wider color reproduction range and a higher superiority of the image forming apparatus. As a method of expanding the color gamut, it is conceivable to employ, for example, a method of separately adding developers of four dark colors of Y, M, C, and K to developers of four colors of Y, M, C, and K or a method of increasing the amount of developer on a recording material. For example, in Japanese Patent Application Laid-Open No. H08-227222, there is disclosed a proposal of adjusting the hue of a secondary color by changing the rotation speed of the developer supply member. The proposal aims at hue adjustment and does not aim at increasing the amount of developer on a recording material, but it is possible to widen the color gamut by applying this technology. That is, it is possible to increase the amount of developer by increasing the rotation speed of the developer supply member.

Meanwhile, there is also a demand of a user for suppressing toner consumption even at the expense of the color gamut. To meet such a demand, for example, the configuration of Japanese Patent Application Laid-Open No. H08-227222 can be employed to suppress the toner consumption by reducing the rotation speed of the developer supply member.

However, the related art has the following problems. In the method of separately adding developers of four dark colors of Y, M, C, and K to developers of four colors of Y, M, C, and K, the image forming apparatus is increased in size due to the addition of the developers. In addition, in the related art, the wear of toner and members progresses when the rotation speed is maintained at a high level, and hence it is preferred to provide a dedicated image formation mode as a wide color gamut image formation mode. However, a color balance is lost in the wide color gamut image formation mode without an image formation condition dedicated to this mode. It is also conceivable to provide a toner consumption saving mode for a user who wishes to extend the life of cartridges by suppressing the toner consumption. However, in the same manner as in the wide color gamut image formation mode, the color balance is also lost in the toner consumption saving mode without an image formation condition dedicated to this mode. In order to obtain the image formation condition dedicated to each mode, the hue adjustment is required for each image formation mode, which increases the downtime of the image forming apparatus for that purpose.

SUMMARY OF THE INVENTION

In order to solve the above-mentioned problems, according to one embodiment of the present invention, there is provided an image forming apparatus, comprising:

a photosensitive drum;

an exposure unit configured to expose the photosensitive drum to light to form an electrostatic latent image on the photosensitive drum;

a developing roller configured to develop the electrostatic latent image on the photosensitive drum which has been formed by the exposure unit with toner to form a toner image on the photosensitive drum;

a belt, the toner image formed on the photosensitive drum being transferred onto the belt or a recording material carried by the belt;

a detection unit configured to detect a density of an image for detection formed on the belt; and a controller configured to perform hue adjustment based on a result of detecting the density of the image for detection by the detection unit, wherein the image forming apparatus is operable so as to perform image formation in a second mode using a color gamut different from a color gamut in a first mode, and wherein the controller is configured to obtain a lookup table, which indicates a correlation between image data to be used and input image data in the second mode, based on the result of detecting the density of the image for detection by the detection unit in the first mode and a correlation of density between the first mode and the second mode.

Further features of the present invention will become apparent from the following description of exemplary embodiments with reference to the attached drawings.

DESCRIPTION OF THE EMBODIMENTS

Now, embodiments of the present invention are described in detail with reference to the accompanying drawings. In the following description, like components are denoted by like reference symbols.

First Embodiment

[Image Forming Apparatus]

Figure 1:
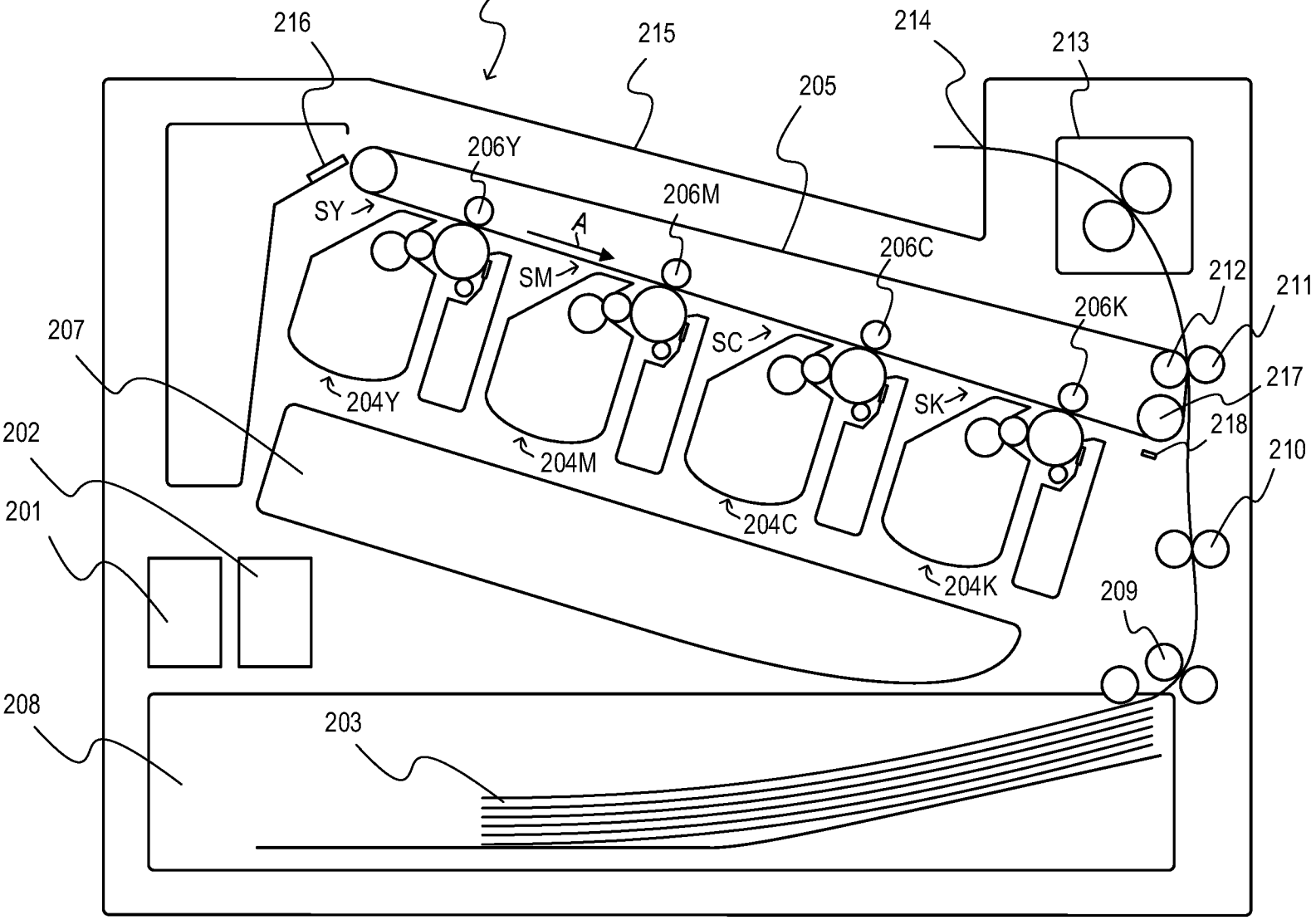
FIG. 1 is a schematic configuration diagram of an image forming apparatus according to each of a first embodiment, a second embodiment, and a third embodiment of the present invention.

FIG. 1 is a schematic configuration diagram of an image forming apparatus 200 according to a first embodiment of the present invention. The image forming apparatus 200 is a full-color laser printer that employs an in-line system and an intermediate transfer system. The image forming apparatus 200 is also an image forming apparatus capable of forming an image in a wide color gamut print mode being a second mode using a color gamut different from a color gamut in a normal print mode being a first mode. The image forming apparatus 200 forms a full-color image on a recording material 203 serving as a transfer material based on image information input from a host computer (hereinafter referred to as "host PC") 222 illustrated in FIG. 5 to an engine controller 202 via a controller 201.

Figure 2A:
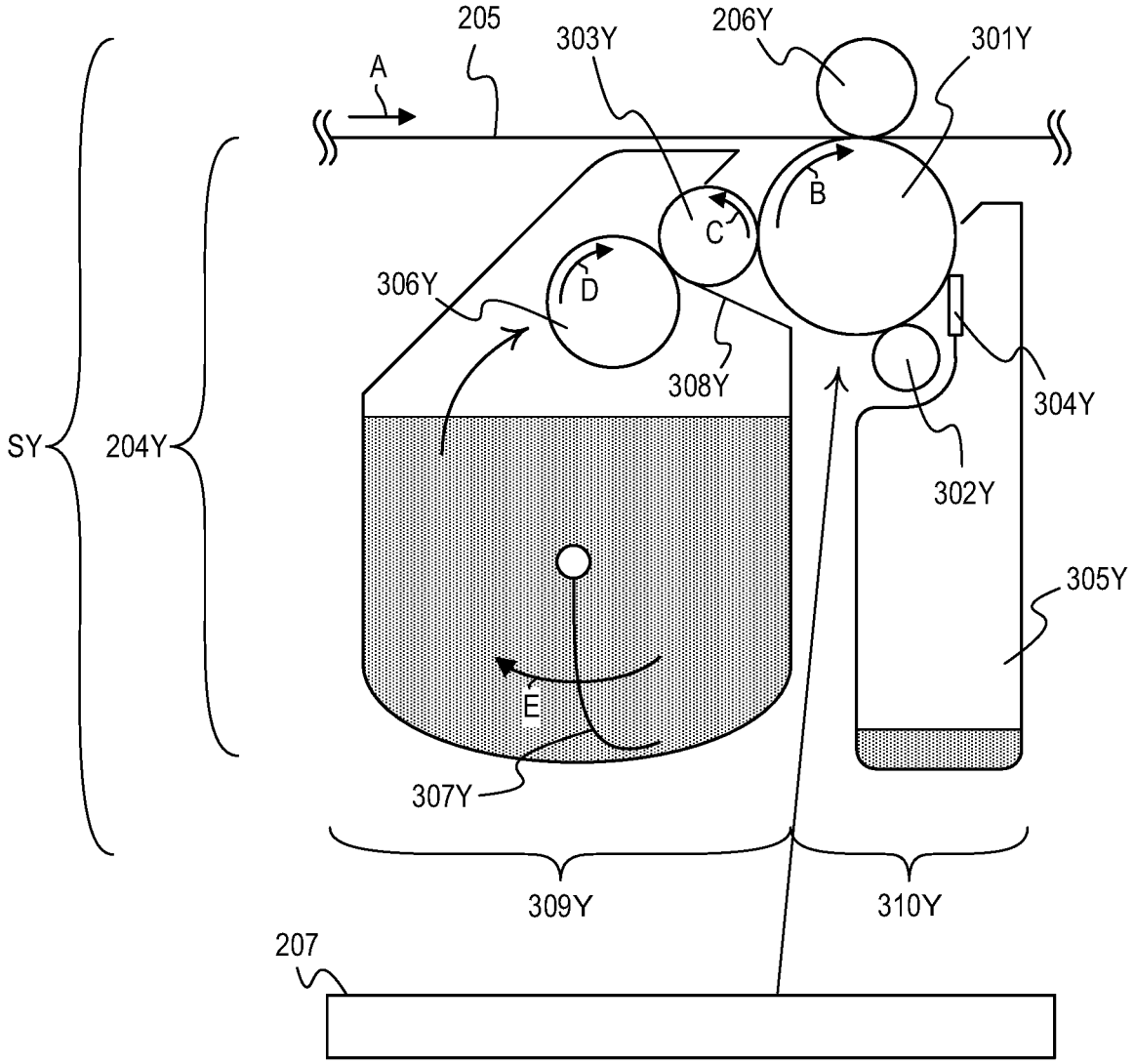
FIG. 2A is a schematic configuration diagram of an image forming station in each of the first embodiment to the third embodiment.

The image forming apparatus 200 includes image forming stations SY, SM, SC, and SK for respective colors. As an example, the image forming station SY for yellow is illustrated in FIG. 2A. The image forming station SY includes a process cartridge 204Y, an intermediate transfer belt 205 configured to be rotated in an arrow-A direction, and a primary transfer roller 206Y arranged on a side opposite to the process cartridge 204Y across the intermediate transfer belt 205. The arrow-A direction illustrated in FIG. 2A is hereinafter referred to as "rotation direction A". The respective image forming stations SY, SM, SC, and SK are arranged in alignment with each other in the rotation direction A of the intermediate transfer belt 205, and are substantially the same as one another except for the color of an image to be formed. Therefore, unless otherwise distinguished from one another, the respective image forming stations SY, SM, SC, and SK are collectively described by omitting the suffixes Y, M, C, and K each indicating that the component is provided for the corresponding color.

The process cartridge 204 includes a photosensitive drum 301 serving as an image bearing member. The photosensitive drum 301 is rotationally driven in an arrow-B direction by a drive unit (not shown). A charging roller 302 has a high voltage applied by a high-voltage power supply (not shown), to thereby uniformly charge the surface of the photosensitive drum 301. Then, a scanner unit 207 serving as an exposure unit irradiates the photosensitive drum 301 with laser light based on the image information input to the engine controller 202, to thereby form an electrostatic latent image on the surface of the photosensitive drum 301. A developing roller 303 serving as a developer supply unit is rotated in an arrow-C direction by a drive unit (not shown). Toner serving as developer, which has been charged to coat the surface of developing roller 303, adheres along the electrostatic latent image on the surface of the photosensitive drum 301, to thereby cause the electrostatic latent image to become a visible image. In the following description, the visible image based on the toner is referred to as "toner image".

A base layer of the photosensitive drum 301 is grounded, and a voltage having a polarity reverse to that of the toner is applied to the primary transfer roller 206 by a high-voltage power supply (not shown). Therefore, an electric field is formed at a nip portion formed between the primary transfer roller 206 and the photosensitive drum 301, and the toner image is transferred from the photosensitive drum 301 onto the intermediate transfer belt 205. The intermediate transfer belt 205 is stretched around an opposing roller 217 as well, and a density sensor 218 is provided on a side opposite to the opposing roller 217 across the intermediate transfer belt 205.

The toner remaining on the surface of the photosensitive drum 301 that cannot be completely transferred onto the intermediate transfer belt 205 is removed from the photosensitive drum 301 by a drum cleaning blade 304 to be collected in a waste toner container 305. A toner replenishing roller 306 is rotated in an arrow-D direction to replenish the developing roller 303 with the toner, and an agitator 307 is rotated in an arrow-E direction to replenish the toner replenishing roller 306 with the toner. A toner regulating blade 308 is fixed, and hence the developing roller 303 is rubbed by the toner regulating blade 308 due to its own rotation. The toner coating the surface of the developing roller 303 has the amount regulated while being charged at this rubbing portion. As a result, the toner image can be developed with a stable density. A configuration including the developing roller 303, the agitator 307, the toner replenishing roller 306, and the toner regulating blade 308 is hereinafter referred to collectively as "developing unit 309". Meanwhile, a configuration including the photosensitive drum 301, the charging roller 302, the drum cleaning blade 304, and the waste toner container 305 is hereinafter referred to collectively as "drum unit 310".

The image forming apparatus 200 according to the first embodiment can not only use the normal print mode as a reference image formation mode but also use the wide color gamut print mode as a variable density image formation mode. In the wide color gamut print mode, a difference (hereinafter referred to as "circumferential speed difference") between the circumferential speed of the developing roller 303 and the circumferential speed of the photosensitive drum 301 is set greater than that in the normal print mode so that a toner amount per unit area on the photosensitive drum 301 (on a photosensitive drum) is increased to achieve a wider color gamut. That is, in the wide color gamut print mode, the circumferential speed difference is increased so that the supply amount of toner becomes greater than in the normal print mode. This requires the setting of the surface potential of the photosensitive drum 301, which is described later in detail.

The intermediate transfer belt 205 is rotated in the rotation direction A, to thereby cause toner images generated in the image forming stations S for the respective colors to be formed on the intermediate transfer belt 205 and carried. The recording materials 203 are received to be stacked in a feed cassette 208. Sheet feeding rollers 209 are driven based on a feed start signal, to thereby feed each of the recording materials 203. A registration roller pair 210 starts to convey the recording material 203 so that the recording material 203 arrives at the nip portion (hereinafter also referred to as "secondary transfer portion") formed between a secondary transfer roller 211 and a secondary transfer opposing roller 212 at a predetermined timing.

Specifically, the recording material 203 is conveyed so that the leading edge portion of the toner image on the intermediate transfer belt 205 and the leading edge portion of the recording material 203 meet each other at a predetermined timing. While the recording material 203 is nipped and conveyed between the secondary transfer roller 211 and the secondary transfer opposing roller 212, a voltage having a polarity reverse to that of the toner is applied to the secondary transfer roller 211 from a power supply apparatus (not shown). The secondary transfer opposing roller 212 is grounded, and hence an electric field is formed between the secondary transfer roller 211 and the secondary transfer opposing roller 212. This electric field causes the toner image to be transferred from the intermediate transfer belt 205 onto the recording material 203. After passing through the nip portion between the secondary transfer roller 211 and the secondary transfer opposing roller 212, the recording material 203 is subjected to heating and pressurizing processing by a fixing device 213. This causes the toner image on the recording material 203 to be fixed to the recording material 203. After that, the recording material 203 is conveyed from an outlet 214 to a delivery tray 215, and thus the process of image formation is completed. Meanwhile, the toner on the intermediate transfer belt 205 that cannot be completely transferred by the secondary transfer portion is removed from the intermediate transfer belt 205 by a cleaning member 216, and the intermediate transfer belt 205 is refreshed to a state that allows the image formation again.

[Photosensitive Drum]

Figure 2B:
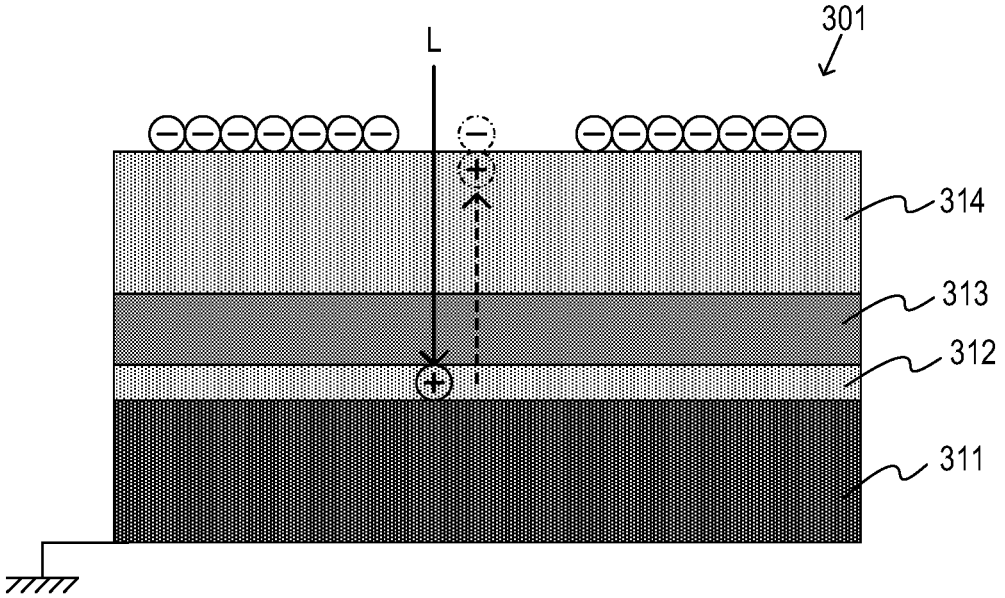
FIG. 2B is a schematic explanatory diagram of a layer structure of a photosensitive drum.

FIG. 2B is a diagram for illustrating a layer structure of the photosensitive drum 301. The photosensitive drum 301 is structured of layers in order from the bottom layer as follows. The photosensitive drum 301 is formed of a drum base 311 made of aluminum or other such conductive material, an undercoat layer 312 for suppressing the interference of light and improving the adhesive property of an upper layer, a charge generation layer 313 for generating a carrier, and a charge transport layer 314 for transporting the generated carrier. The drum base 311 is grounded, and the surface of the photosensitive drum 301 is charged by the charging roller 302 so that an electric field directed from the inside of the photosensitive drum 301 toward the outside is formed. When the photosensitive drum 301 is irradiated with laser light L by the scanner unit 207, a carrier (circle with a plus sign) is generated by the charge generation layer 313. This carrier is moved by the above-mentioned electric field (broken line) to be paired with a charge (circle with a minus sign) on the surface of the photosensitive drum 301, to thereby change the surface potential of the photosensitive drum 301.

[Surface Potential of Photosensitive Drum or the Like]

Figure 3:
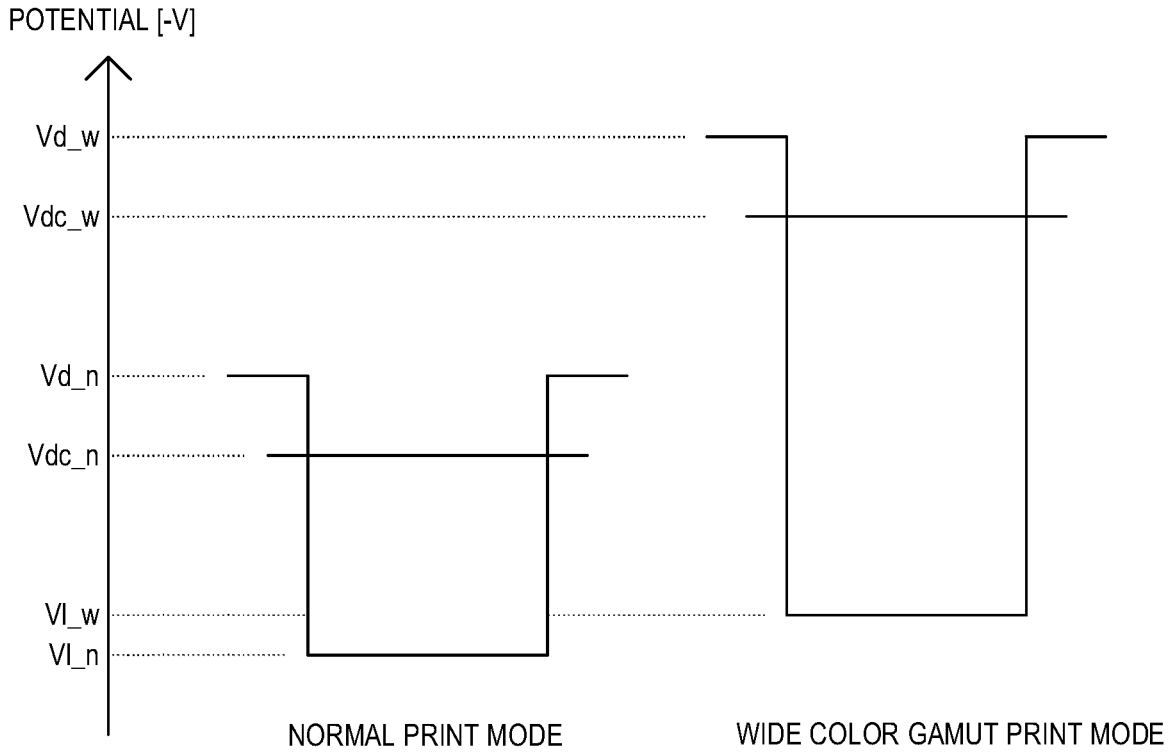
FIG. 3 is a schematic explanatory graph of a surface potential of the photosensitive drum in the first embodiment.

The surface potential of the photosensitive drum 301 in the normal print mode and the wide color gamut print mode is described with reference to FIG. 3. In FIG. 3, the vertical axis represents a potential (−V). First, the potential to which the surface of the photosensitive drum 301 is charged by the charging roller 302 is set as a charging potential Vd. After that, the surface potential of the photosensitive drum 301, which has been exposed to light, is changed to an exposure potential Vl. A voltage is applied to the developing roller 303 by a high-voltage power supply (not shown) so as to maintain a developing potential Vdc. The developing potential Vdc is set between the exposure potential Vl and the charging potential Vd. Therefore, in a non-exposure section, an electric field is formed in a direction reverse to a direction in which the toner coating the surface of the developing roller 303 is developed toward the photosensitive drum 301 side, while in an exposure section, an electric field is formed in the direction in which the toner is developed toward the photosensitive drum 301 side. The toner is developed in the exposure section based on the electric field, but the surface potential of the photosensitive drum 301 increases due to a toner charge as more toner is developed, and hence the electric field becomes weaker in the exposure section. Therefore, even when the circumferential speed difference is increased with the aim of increasing a toner supply amount, the toner amount on the photosensitive drum 301 is saturated with a certain circumferential speed difference. In order to increase the toner amount on the photosensitive drum 301, it is required to set a sufficient potential contrast (Vdc−Vl). In this case, the potential contrast of Vdc−Vl is set as a potential contrast Vcont. However, even when the exposure amount is increased under a state in which the charges based on the charging voltage have sufficiently disappeared due to the exposure, the electric field inside the photosensitive drum 301 has become weaker, and hence the carrier generated in the charge generation layer 313 is not moved to the surface, which inhibits the potential from being changed. Therefore, in order to set a higher potential contrast Vcont, a higher charging voltage is required.

As described above, in the normal print mode for a construction of the first embodiment, a circumferential speed difference of 140%, Vd_n=−500 V, Vdc_n=−350 V, and Vl_n=−100 V are employed. Meanwhile, in the wide color gamut print mode, the circumferential speed difference of 280%, Vd_w=−850 V, Vdc_w=−600 V, and Vl_w=−120 V are employed. In this case, the charging voltage Vd, the developing potential Vdc, and the exposure potential Vl are represented by Vd_n, Vdc_n, and Vl_n, respectively, in the normal print mode, and represented by Vd_w, Vdc_w, and Vl_w, respectively, in the wide color gamut print mode. Each of the potentials in each print mode is set to a sufficient value required for developing the toner coating the surface of the developing roller 303. Therefore, even when the potential fluctuates for some reason, the toner amount to be developed does not change, which stabilizes the density. However, assuming that each of the potentials in the wide color gamut print mode is employed in the normal print mode, when the potential fluctuates, the toner amount to be developed changes in accordance with the fluctuation, which impairs the stability of the density. As described above, in the first embodiment, Vd_n, Vdc_n, and Vl_n are employed, instead of Vd_w, Vdc_w, and Vl_w, as the respective potentials in the normal print mode from the viewpoint of the stability of the density.

[Density Sensor]

Figure 4A:
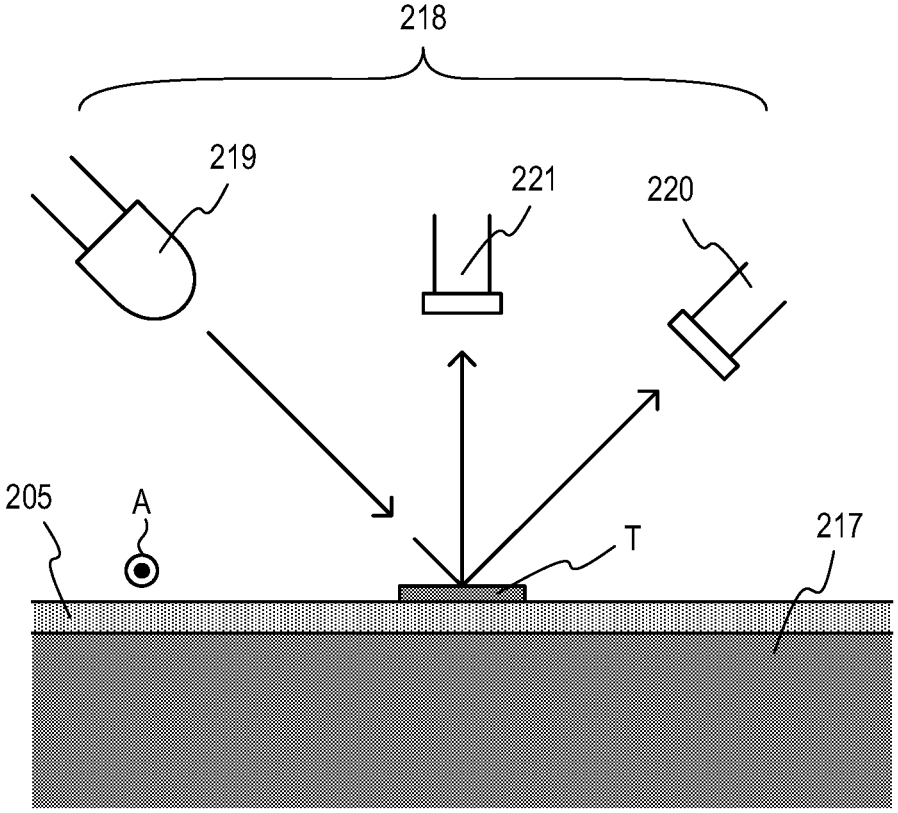
FIG. 4A is a schematic explanatory diagram of a configuration of a density sensor in each of the first embodiment to the third embodiment.

In an electrophotographic image forming apparatus, the hue of printed matter varies depending on various conditions including the use state of the cartridge and the use environment. Therefore, it is required to measure the density as appropriate and feed back the density to a control mechanism inside an image forming apparatus main body. FIG. 4A is a diagram for illustrating a schematic configuration of the density sensor 218 serving as a density measuring unit. After having been transferred onto the surface of the intermediate transfer belt 205 in the image forming station S, a toner image T is carried to the position of the opposing roller 217 in accordance with the rotation of the intermediate transfer belt 205. The density sensor 218 is arranged on a side opposite to the opposing roller 217 across the intermediate transfer belt 205. The density sensor 218 mainly includes a light emitting element 219, a specularly-reflected-light receiving element 220, and a diffusely-reflected-light receiving element 221. The light emitting element 219 emits infrared light, and the infrared light is reflected by the surface of the toner image T. The specularly-reflected-light receiving element 220 is arranged in a specular reflection direction with respect to the position of the toner image T, and detects light specularly reflected at the position of the toner image T. The diffusely-reflected-light receiving element 221 is arranged at a position other than a position in the specular reflection direction with respect to the toner image T, and detects light diffusely reflected at the position of the toner image T. The rotation direction A in FIG. 4A is the same as the above-mentioned rotation direction A of the intermediate transfer belt 205, and in FIG. 4A, the intermediate transfer belt 205 is moved from the back of the drawing sheet toward the front.

[Sensor Output]

Figure 4B:
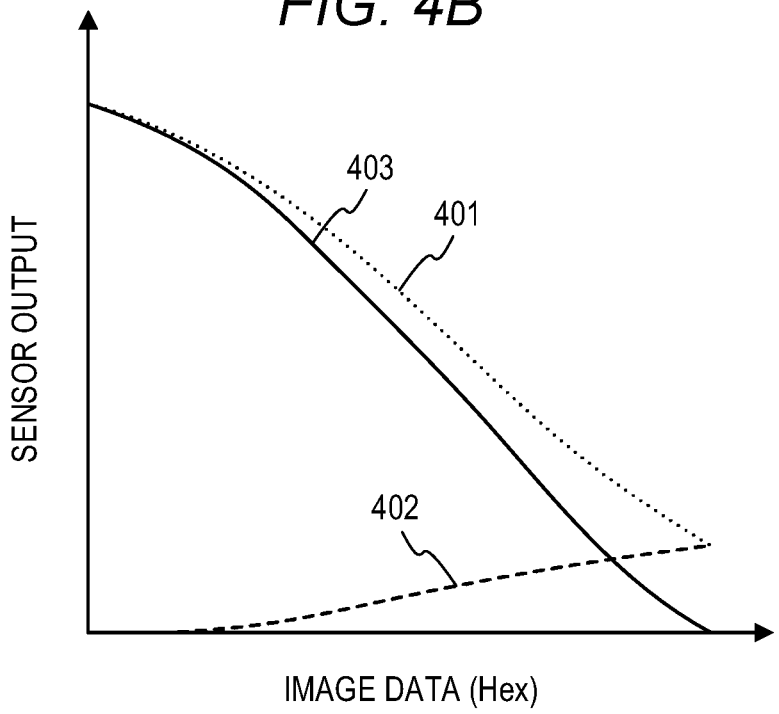
FIG. 4B is a schematic explanatory graph of a density sensor output.

FIG. 4B is a graph for showing output results obtained by the density sensor 218. In FIG. 4B, the horizontal axis represents image data, which is expressed in hexadecimal (Hex), and the vertical axis represents an output (sensor output) from the density sensor 218. When the toner image T has a small toner amount, that is, when the image data has a small value, the density sensor 218 detects the reflection from the surface of the intermediate transfer belt 205, which is smooth, mirror finished, and black, and hence a specular reflection detecting output 401 (dotted line) is large, while a diffuse reflection detecting output 402 (broken line) is small. The particle diameter of the toner is larger than the scale of the surface properties of the intermediate transfer belt 205. Therefore, when the toner is increased, that is, when the image data has a larger value, the specular reflection detecting output 401 becomes smaller, while the diffuse reflection detecting output 402 becomes larger. The specular reflection detecting output 401 includes a diffuse reflection component, and hence it is possible to obtain a sensor output 403 (solid line) correlated with the density by subtracting the diffuse reflection component from the specular reflection detecting output 401 based on the diffuse reflection detecting output 402. As described above, the density is calculated based on the detection results of the specularly reflected light and the diffusely reflected light, which are obtained by the density sensor 218.

[Image Processing]

Figure 5:
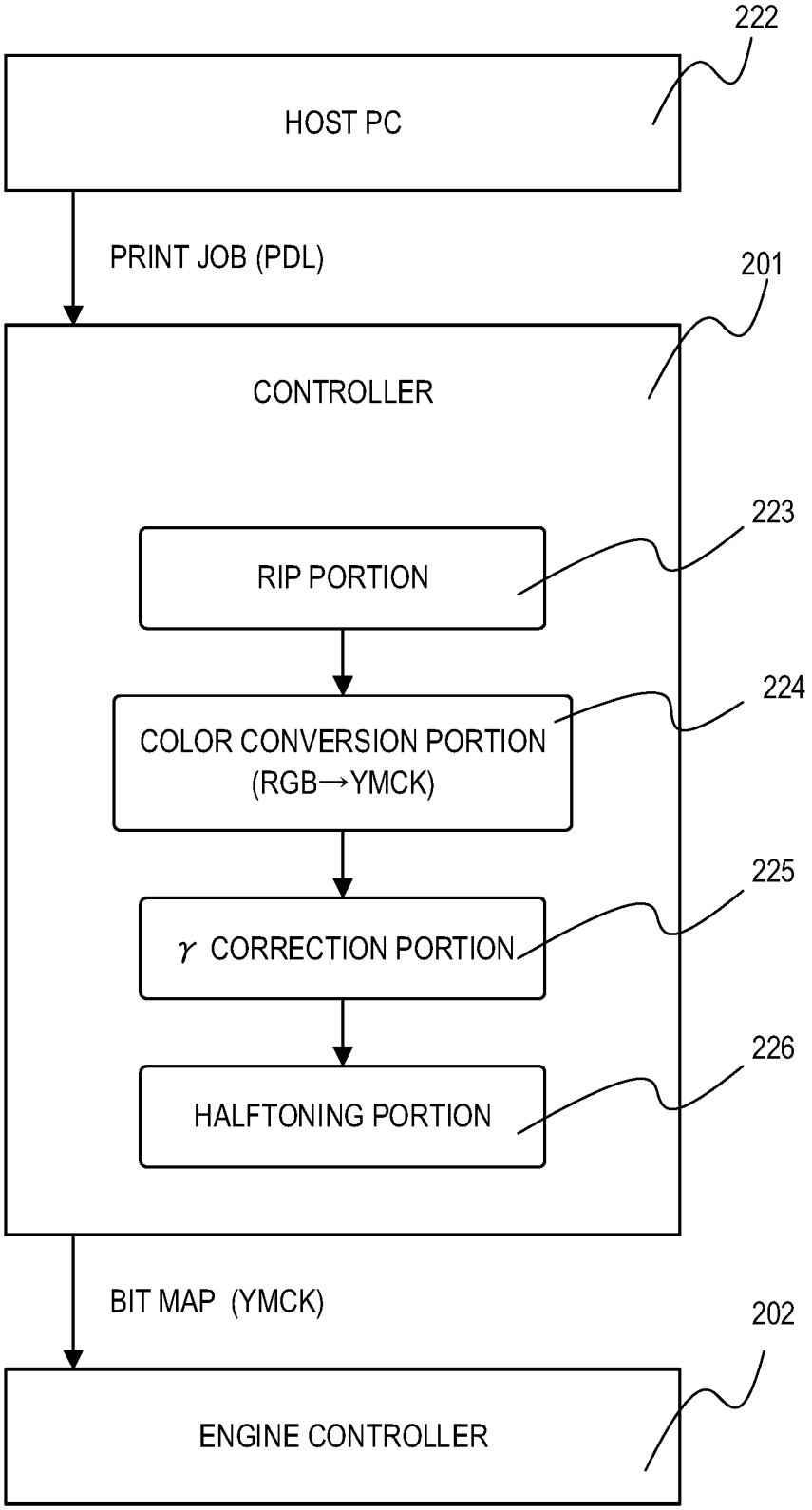
FIG. 5 is a schematic explanatory diagram of controller processing in each of the first embodiment to the third embodiment.

Next, it is described how hue information obtained by the density sensor 218 is used for correction. In FIG. 5, an outline of a flow of controller processing is illustrated. In general, a print job described in PCL, PostScript, or other such page description language (PDL) is transmitted from the host PC 222 or the like to the controller 201. The controller 201 transmits bitmap information on Y, M, C, and K to the engine controller 202 mainly via a raster image processor (RIP) portion 223, a color conversion portion 224, a γ correction portion 225, and a halftoning portion 226.

Specifically, the RIP portion 223 subjects the print job described in PDL, which has been transmitted from the host PC 222, to a file analysis (by an interpreter), and performs conversion into an RGB bitmap corresponding to the resolution of the image forming apparatus 200. In general, a color reproduction range of the electrophotographic image forming apparatus is narrower than a color reproduction range of a liquid crystal display. Therefore, the color conversion portion 224 in the subsequent stage performs color matching so as to match the hue as much as possible in consideration of a difference in color reproduction range between devices. The color conversion portion 224 also performs, for example, conversion from RGB data into YMCK data. After that, the γ correction portion 225 performs gamma correction, and the halftoning portion 226 performs dithering or other such gradation expression processing. The detection results obtained by the density sensor 218 are used for selecting appropriate image data by the γ correction portion 225.

[Lookup Table]

Figure 6A:
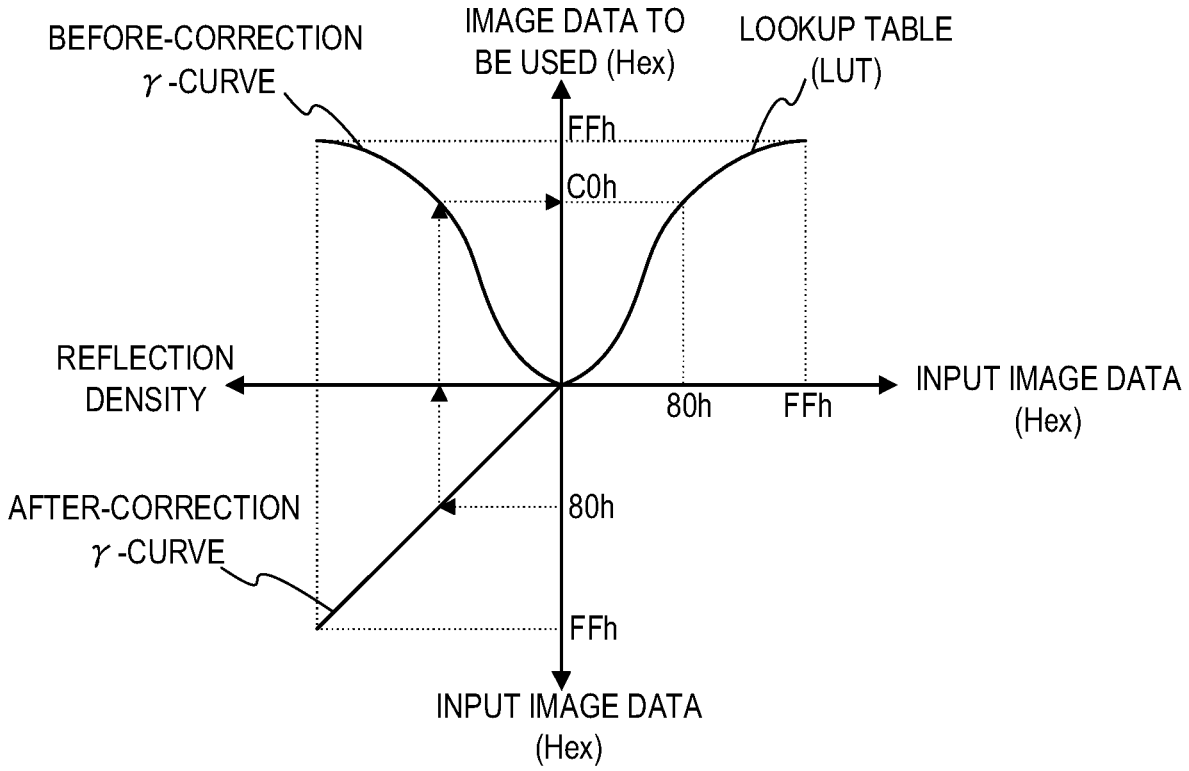
FIG. 6A is a schematic explanatory graph of a lookup table at the time of a normal print mode in the first embodiment.

In FIG. 6A, a lookup table (LUT) is shown. In the first quadrant of FIG. 6A, a graph of a lookup table is shown, and the horizontal axis represents input image data, which is expressed in hexadecimal (Hex), while the vertical axis represents image data to be used, which is expressed in hexadecimal. In the second quadrant of FIG. 6A, a before-correction γ-curve is shown, and the horizontal axis represents a reflection density, while the vertical axis represents the image data to be used in the same manner as in the first quadrant. The reflection density is also referred to simply as "density". In the third quadrant of FIG. 6A, an after-correction γ-curve is shown, and the horizontal axis represents the reflection density in the same manner as in the second quadrant, while the vertical axis represents the input image data. The graph shown in the second quadrant of FIG. 6A is the before-correction γ-curve. Normally, the before-correction γ-curve has no linearity. Therefore, the input image data is not used as it is, and such image data as to maintain linearity is selected to be used. A table indicating a correlation between this input image data and the image data to be actually used is referred to as "lookup table". In addition, processing for recreating the lookup table based on the characteristic of the current image forming apparatus main body is referred to as "gamma correction". It is assumed to be ideal that, as shown in the third quadrant of FIG. 6A, there is linearity in a relationship between the input image data and the reflection density. This graph is a graph for showing a general relationship between the input image data and the reflection density and the like. The data of this graph is, for example, data obtained based on a result of measuring the density of an image after fixation, which has been printed on the recording material 203, by an external measuring apparatus or the like. For example, it is understood in this example that it is required to use the image data of C0h in order to obtain an ideal density for the input image data of 80h in consideration of the characteristic (before-correction γ-curve) of the current image forming apparatus main body shown in the second quadrant of FIG. 6A.

Figure 6B:
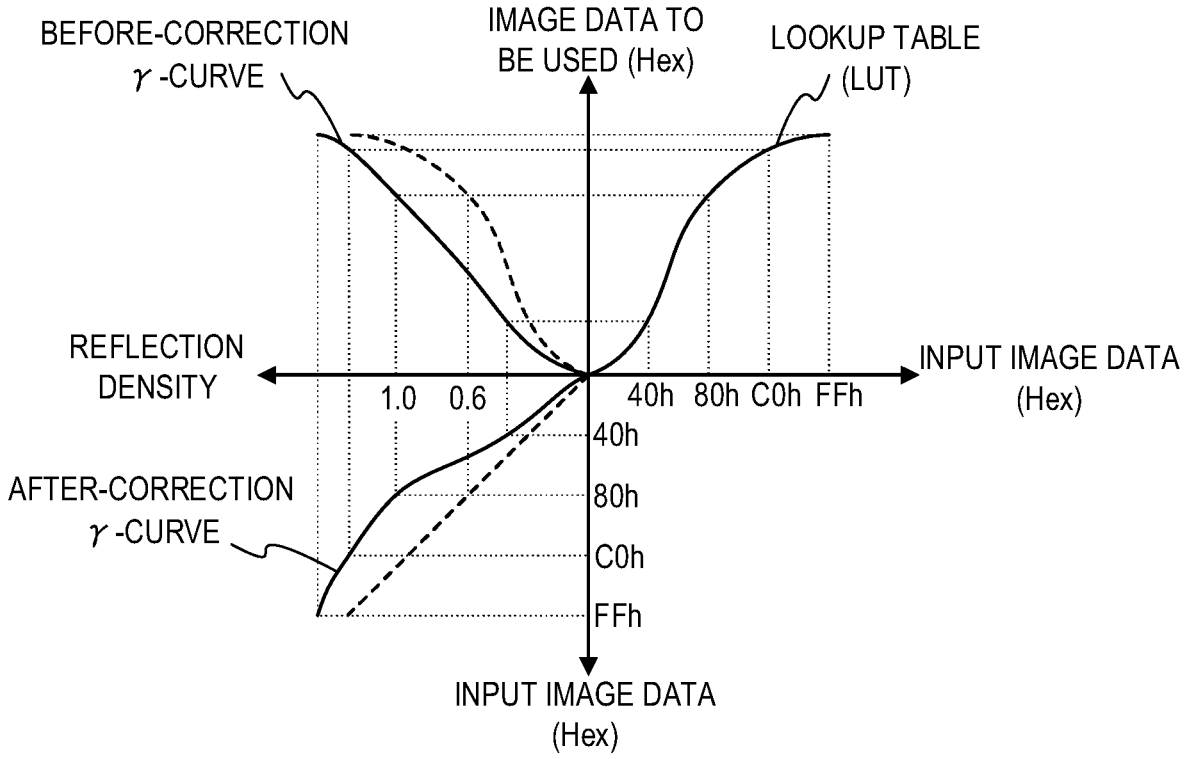
FIG. 6B is a schematic explanatory graph of a lookup table at the time of a wide color gamut print mode in the first embodiment.

The before-correction γ-curve is the characteristic of the current image forming apparatus itself, and varies depending on various conditions including the cartridge and the use environment. The same applies to a difference between print modes, for example, the normal print mode and the wide color gamut print mode. A graph of FIG. 6B is plotted in the same manner as in the graph of FIG. 6A, and descriptions of the horizontal axis, the vertical axis, and the like are omitted. FIG. 6B is a graph for showing how the reflection density deviates from the linearity when printing is performed in the wide color gamut print mode through use of the lookup table optimized for the normal print mode. In FIG. 6B, the broken line in the second quadrant indicates the characteristic of the image forming apparatus main body in the normal print mode, and the graph of the broken line is the same as the graph of the second quadrant of FIG. 6A. Meanwhile, in FIG. 6B, the solid line in the second quadrant indicates the characteristic (before-correction γ-curve) of the image forming apparatus main body in the wide color gamut print mode. The wide color gamut print mode is a print mode of increasing the toner amount by increasing the circumferential speed difference of the developing roller 303 from the photosensitive drum 301. Therefore, in the wide color gamut print mode, the reflection density is higher than in the normal print mode over the entire image data area. When the image formation is performed based on the input image data of 80h, the reflection density is about 0.6 in the normal print mode, while the reflection density increases to 1.0 in the wide color gamut print mode.

As a result, as shown in the third quadrant of FIG. 6B, the after-correction γ-curve (broken line) in the normal print mode has linearity, while the after-correction γ-curve (solid line) in the wide color gamut print mode does not have linearity, and has a lopsided shape. Therefore, it is normally required to obtain a lookup table in the wide color gamut print mode after grasping the gamma through use of the density sensor 218 also in the wide color gamut print mode in the same manner as in the normal print mode. However, in order to obtain the LUT for the wide color gamut print mode, it is required to add the step of forming a toner image for detection on the intermediate transfer belt 205 and measuring the density of the toner image for detection by the density sensor 218 also in the wide color gamut print mode separately from the normal print mode. This causes downtime for obtaining a LUT in the wide color gamut print mode. Therefore, in the construction of the first embodiment, the lookup table in the wide color gamut print mode is created based on the density information in the normal print mode, the circumferential speed difference of the developing roller 303 from the photosensitive drum 301, use information on the cartridge, and other such information. Now, parameters required when the density information in the wide color gamut print mode is calculated from the density information in the normal print mode are described.

[Circumferential Speed Difference of Developing Roller 303]

Figure 7A:
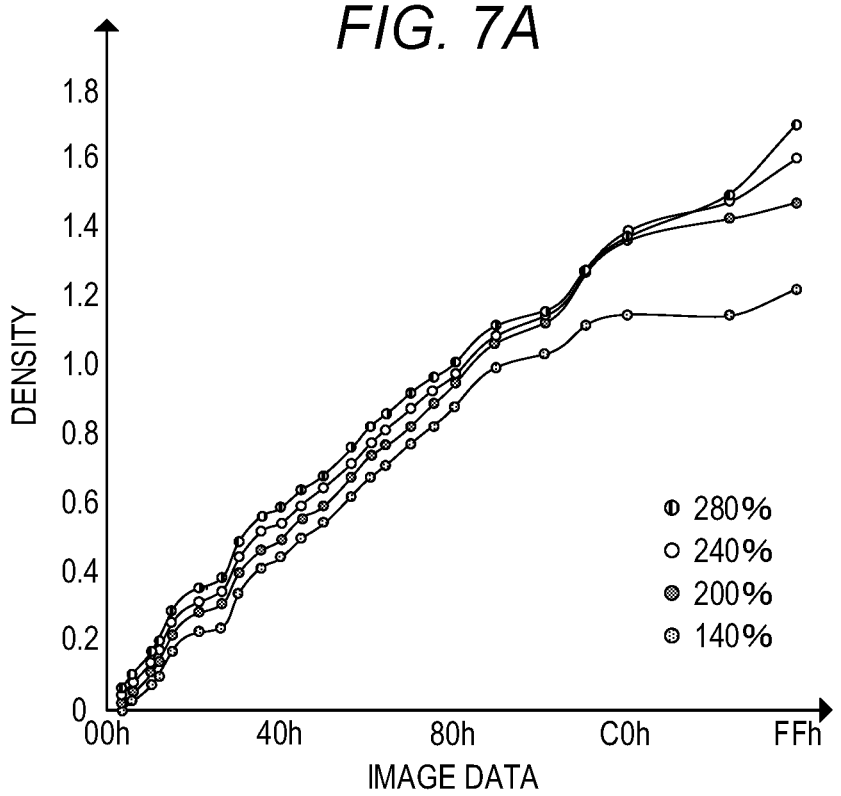
FIG. 7A is a schematic explanatory graph of densities based on the circumferential speed of a developing roller in the first embodiment.

FIG. 7A is a graph for showing a density exhibited when the circumferential speed difference is changed under potential settings in the wide color gamut print mode, namely, Vd_w=−850 V, Vdc_w=−600 V, and Vl_w=−120 V. In FIG. 7A, the horizontal axis represents the image data, and the vertical axis represents the density (OD). The data is obtained when the circumferential speed difference is 140%, 200%, 240%, and 280%. It is understood that, in any gradation (image data), the density becomes higher as the circumferential speed difference becomes greater. As has been described so far, this is because the toner amount supplied to the photosensitive drum 301 is increased by increasing the circumferential speed difference. Therefore, in order to calculate the density information in the wide color gamut print mode from the density information in the normal print mode, it is required to include the circumferential speed difference as one of the parameters.

[Degree of Use of Photosensitive Drum 301]

Figure 7B:
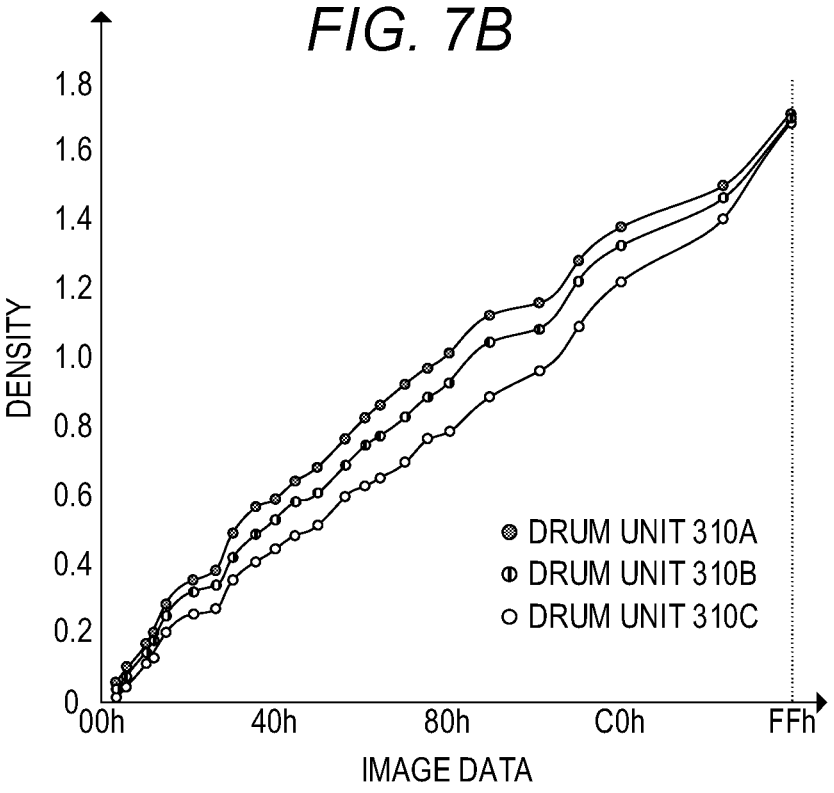
FIG. 7B is a schematic explanatory graph of densities based on a degree of use of the photosensitive drum in the first embodiment.

FIG. 7B is a graph for showing differences in density in the wide color gamut print mode among drum units exhibiting different degrees of use. The horizontal axis and the vertical axis of FIG. 7B are the same as those of FIG. 7A, and descriptions thereof are omitted. A drum unit 310A is in a new condition, a drum unit 310B has printed 20,000 recording materials 203, and a drum unit 310C has printed 50,000 recording materials 203. As the number of printed recording materials 203 becomes greater, that is, as the use of the photosensitive drum 301 progresses, the density becomes lower (lighter) over the entire image data area. This is because the sensitivity of the photosensitive drum 301 to a light amount of light emitted by the scanner unit 207 is changed due to the use.

Figure 8A:
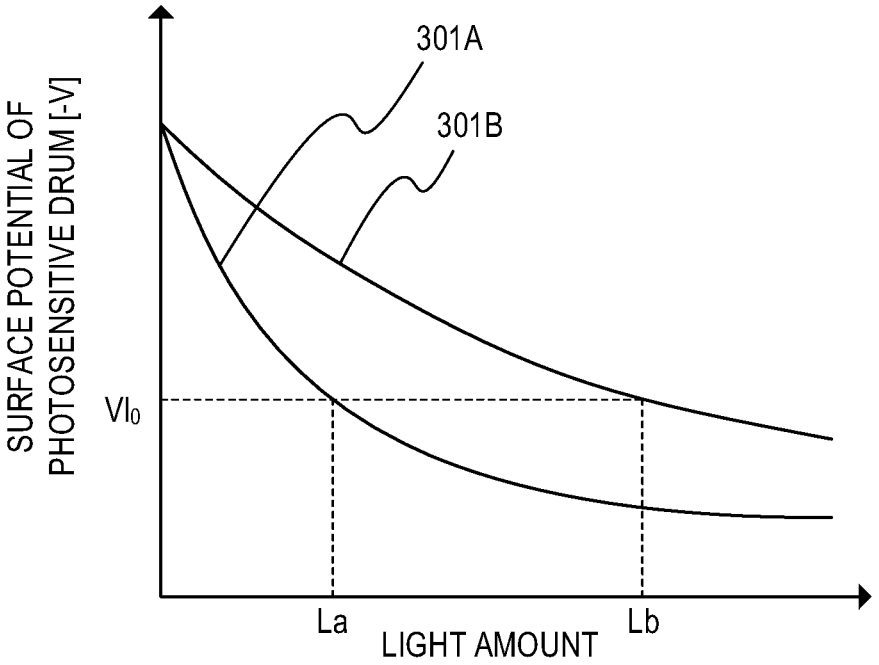
FIG. 8A is a schematic explanatory graph of the surface potential with respect to a light amount based on the degree of use of the photosensitive drum in the first embodiment.

FIG. 8A is a graph for showing a concept of the characteristics of the light amount of the light emitted by the scanner unit 207 and the surface potential of the photosensitive drum 301. In FIG. 8A, the horizontal axis represents the light amount of the light emitted by the scanner unit 207, and the vertical axis represents the surface potential (−V) of the photosensitive drum 301. In FIG. 8A, a new photosensitive drum 301A and an (old) photosensitive drum 301B exhibiting a large degree of use are shown. The photosensitive drum 301 becomes thinner in thickness as the charge transport layer 314 being the outermost layer of the photosensitive drum 301 is scraped more due to the use. A capacitance increases as the photosensitive drum 301 becomes thinner in thickness, and hence the sensitivity for the surface potential to an amount of charge by which the surface is charged becomes lower. Therefore, when exposure is to be performed to lower the potential to an exposure potential Vl0, which is the same as that of the new photosensitive drum 301A, a light amount La is sufficient for the new photosensitive drum 301A, but the old photosensitive drum 301B requires a larger light amount Lb (Lb>La). This means that, in order to achieve the same density as the density achieved by the new photosensitive drum 301A, the old photosensitive drum 301B requires the image data having a higher density.

As described above, it is understood that the density depends on the number of printed recording materials 203 that have been printed by the drum unit 310. As understood from the data shown in FIG. 7B, the drum unit 310B is plotted substantially in the middle between the drum unit 310A and the drum unit 310C, and hence there is considered to be a linear correlation between a change in density due to the printing performed on the recording material 203 and the number of printed recording materials 203.

[Degree of Use of Developing Unit 309]

Figure 8B:
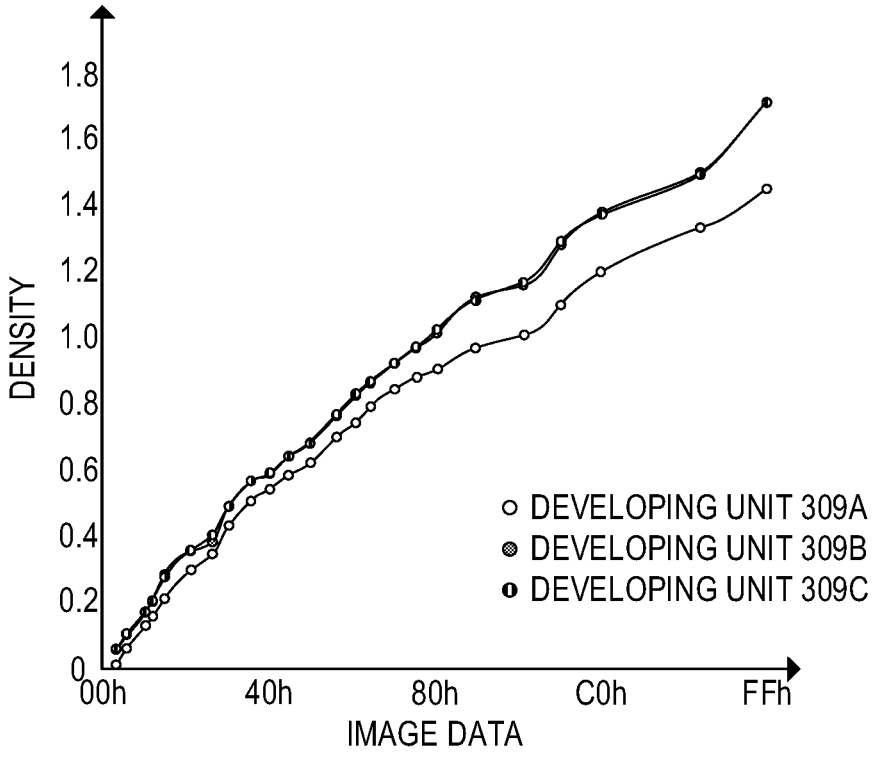
FIG. 8B is a schematic explanatory graph of densities based on a degree of use of a developing unit in the first embodiment.

FIG. 8B is a graph for showing densities used by the developing units 309 exhibiting different degrees of use in the wide color gamut print mode. The horizontal axis and the vertical axis of FIG. 8B are the same as those of FIG. 7A and FIG. 7B, and descriptions thereof are omitted. A new developing unit 309A exhibits a lower density over the entire image data area than a developing unit 309B subjected to the printing of 3,000 recording materials 203 at a coverage rate of 5%. This is ascribable to the fact that toner having a small particle diameter is relatively easily consumed at the beginning and is easily charged due to rubbing with the toner regulating blade 308. As described above, as more toner is developed, a potential difference from Vdc decreases due to the charge of the toner itself. This phenomenon is expressed as the potential contrast Vcont (=Vdc-Vl) being gradually filled. As the potential contrast Vcont is gradually filled with more toner charges, development is gradually performed less often. In higher charging, a larger part of the potential contrast Vcont is gradually filled, with the result that the density is lowered. The term "high charging" mentioned above refers to being large in the minus direction, and the charging becomes higher at a higher position on the vertical axis of the graph of FIG. 3. Meanwhile, a developing unit 309C subjected to the printing of 30,000 recording materials 203 at the same coverage rate of 5% as that of the developing unit 309B exhibits a density substantially the same as that of the developing unit 309B. This is considered to be because, with the construction of the first embodiment, most of the toner having a small particle diameter has been consumed at a timing at which about 3,000 recording materials 203 have been printed.

As described above, it is understood that the density depends on a toner use amount. The toner use amount of toner used when 3,000 recording materials 203 are printed at the coverage rate of 5% is a minute amount compared to the whole toner amount. For this reason, it is assumed that, in the first embodiment, the density linearly changes until the toner use amount equivalent to the amount of toner used when 3,000 recording materials 203 are printed at the coverage rate of 5%, and after that, the density maintains a constant level without changing.

It is understood from FIG. 7A, FIG. 7B, and FIG. 8B that the circumferential speed difference of the developing roller 303, the degree of use of the drum unit 310, the consumption degree of the toner, and other such factor influence on a relationship between the density information in the normal print mode and the density information in the wide color gamut print mode. Therefore, a correlation table between the density information in the normal print mode and the density information in the wide color gamut print mode under each condition (predetermined condition) is provided in advance so that hue adjustment can be performed without measuring the density in the wide color gamut print mode in addition to the normal print mode.

[Creation of Correlation Table]

Now, how the correlation table is created and how the correlation table is applied are specifically described. Data required for creating the correlation table includes pieces of density data obtained in the normal print mode and the wide color gamut print mode for the respective circumferential speed differences in the case of using a new drum unit 310, a life-equivalent drum unit 310 exhibiting a high degree of use, a new developing unit 309, and a developing unit 309 subjected to the printing of about 3,000 recording materials 203 at the coverage rate of 5%. Those pieces of density data are based on data obtained by measuring the density of the image after the fixation, which has been formed on the recording material 203, by the external measuring apparatus or the like during, for example, a development process for the image forming apparatus. In order to obtain a desired density in the image finally formed on the recording material 203, the density of the image after the fixation, which has been formed on the recording material 203, is measured by the external measuring apparatus or the like. It is therefore assumed that a table indicating a correlation between the data obtained by measuring the density of the image after the fixation and data obtained by measuring the density of an image before the fixation by the density sensor 218 is stored in advance in, for example, a storage portion (not shown) included in the controller 201.

Figure 9A:
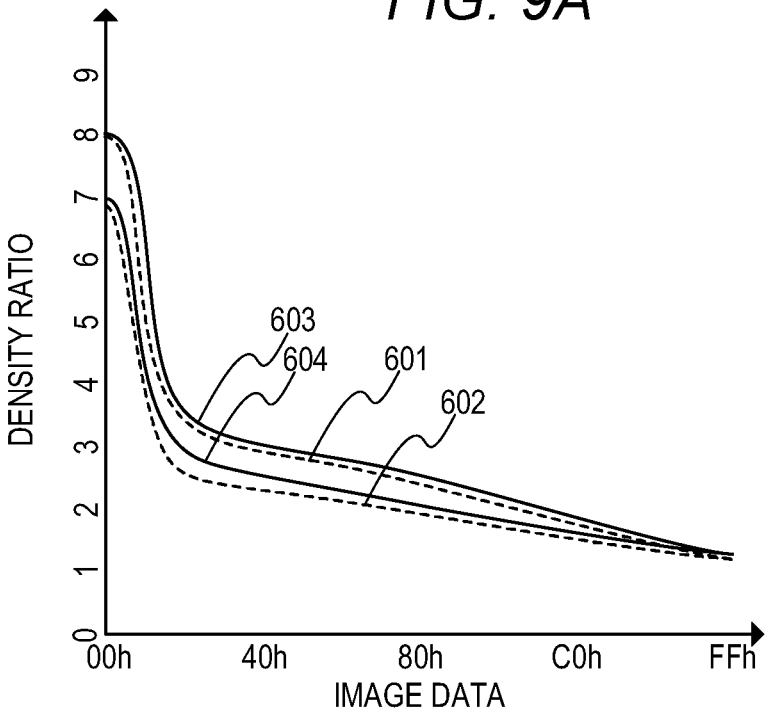
FIG. 9A is a schematic explanatory graph of density ratios between the normal print mode and the wide color gamut print mode in the first embodiment.

As described above, the circumferential speed difference is 280% in the wide color gamut print mode. FIG. 9A is a graph for showing a correlation table for calculating the density at the circumferential speed difference of 280% based on the density information at the circumferential speed difference of 140% in the normal print mode. In FIG. 9A, the horizontal axis represents the image data (gradation), and the vertical axis represents a density ratio.

The correlation table refers to a density ratio between the two print modes, and is defined as a quotient obtained by dividing the density in the wide color gamut print mode by the density in the normal print mode. On a low density side (or a low gradation side or a side on which the image data has a small value), the density in the normal print mode is low, and hence the density ratio tends to be high, and tends to become smaller as the density increases. In addition, the new drum unit 310A has a density ratio higher than that of the drum unit 310C using the photosensitive drum 301 subjected to the printing of 50,000 recording materials 203. This is ascribable to the fact that the drum units 310A and 310C exhibit a larger difference between the densities in the wide color gamut print mode than a difference between the densities in the normal print mode. The difference between the densities in the wide color gamut print mode is as described with reference to FIG. 7B.

When the density in the wide color gamut print mode is to be calculated, first, the current toner use amount is calculated based on the data stored in a nonvolatile memory (not shown) mounted to the process cartridge 204. As described above, the density linearly changes until the toner use amount (predetermined use amount) equivalent to the amount of toner used when 3,000 recording materials 203 are printed at the coverage rate of 5%, and after that, the density maintains a constant level. Therefore, the following item (1) is calculated from a correlation table 601 (first density ratio) for the drum unit 310A and the developing unit 309A and a correlation table 603 (second density ratio) for the drum unit 310A and the developing unit 309B. That is, (1) a correlation table for the drum unit 310A and the current developing unit 309 is calculated. The toner use amount is used for the calculation of the correlation table of the item (1).

Specifically, when the current developing unit 309 has consumed the toner having an amount equivalent to the amount of toner used when 3,000 or more recording materials 203 are printed at the coverage rate of 5%, the correlation table for this case is the same as the correlation table 603. Meanwhile, when the current developing unit has printed only less than 3,000 recording materials 203 at the coverage rate of 5%, the correlation table for this case falls in the middle between the correlation table 601 and the correlation table 603, and the correlation table is calculated on the assumption that the change takes place linearly based on the toner use amount.

In the same manner, the following item (2) is calculated from a correlation table 602 (third density ratio) for the drum unit 310C and the developing unit 309A and a correlation table 604 (fourth density ratio) for the drum unit 310C and the developing unit 309B. That is, (2) a correlation table for the drum unit 310C and the current developing unit 309 is calculated. Subsequently, the use amount of the current drum unit 310 is calculated based on the data stored in the nonvolatile memory (not shown) mounted to the process cartridge 204. Then, the correlation table for the current drum unit 310 and the current developing unit is calculated from the two correlation tables of (1) the correlation table for the drum unit 310A and the current developing unit 309 and (2) the correlation table for the drum unit 310C and the current developing unit 309. The use amount of the drum unit 310 is used for the calculation of the correlation table of the item (2).

The influence of the use amount of the drum unit 310 on the density is calculated on the assumption that the change takes place linearly based on the use amount as described above. That is, the correlation table for the drum unit 310 subjected to the printing of, for example, 25,000 recording materials 203 falls right in the middle between the correlation table for the drum unit 310A and the current developing unit and the correlation table for the drum unit 310C and the current developing unit.

As described above, the controller 201 performs the hue adjustment at, for example, a timing at which the process cartridge 204 is replaced or images have been formed on a predetermined number of recording materials 203. At this time, the controller 201 forms, for example, a patch being a known image for detection on the intermediate transfer belt 205 in the normal print mode, and measures the density of the patch by the density sensor 218. The controller 201 also calculates the correlation table for the current drum unit 310 and the current developing unit 309 based on the correlation tables 601 to 604, which are stored in advance in the storage portion or the like, the toner use amount, and the use amount of the drum unit 310. The controller 201 obtains the lookup table in the wide color gamut print mode based on the detection results obtained by the density sensor 218 in the normal print mode and the correlation table for the current drum unit 310 and the current developing unit 309.

Figure 9B:
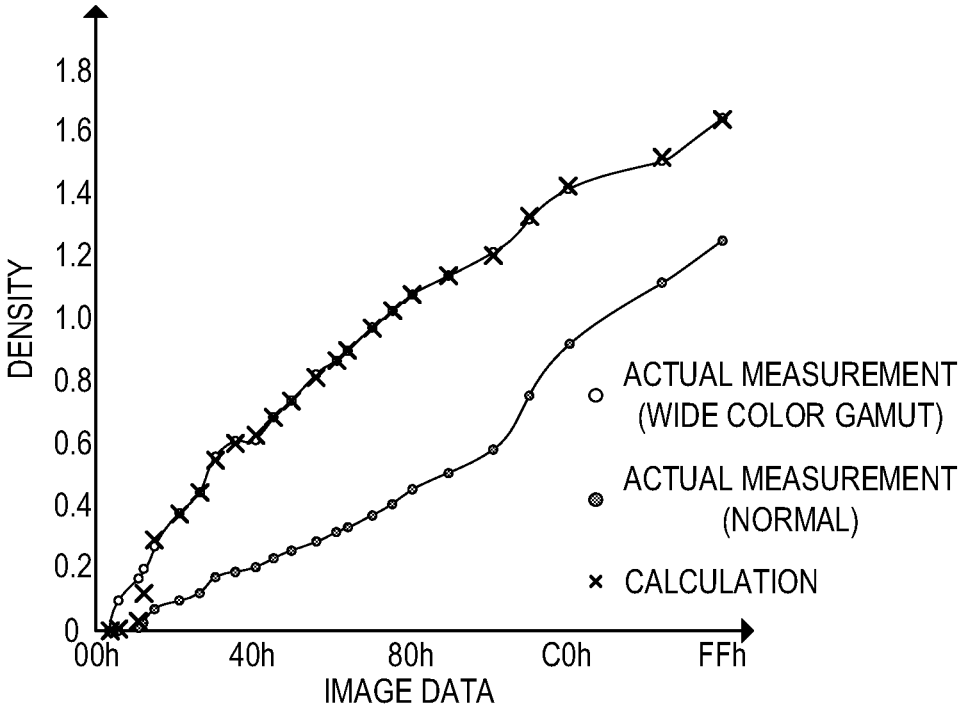
FIG. 9B is a schematic explanatory graph of a calculation accuracy for densities in the wide color gamut print mode in the first embodiment.

The next description is directed to the case of using the developing unit 309B subjected to the printing of 3,000 recording materials 203 at the circumferential speed difference of 280% and the coverage rate of 5% and a drum unit 310D subjected to the printing of about 1,000 recording materials 203 under the same condition in order to verify the correlation table obtained in the above-mentioned manner. FIG. 9B is a graph for showing a result of calculating the density information in the wide color gamut print mode. The horizontal axis and the vertical axis of FIG. 9B are the same as those of FIG. 7A, FIG. 7B, and the like, and descriptions thereof are omitted. In FIG. 9B, the hatched circle indicates actually measured density data in the normal print mode, and the symbol "○" indicates actually measured density data in the wide color gamut print mode. Also in FIG. 9B, the symbol "x" indicates density data calculated by the method of the first embodiment. The correlation table under the above-mentioned condition is obtained by changing the correlation table from the correlation table 603 toward the correlation table 604 by 1/50 (=1,000/50,000) between the correlation table 603 and the correlation table 604. As shown in FIG. 9B, relatively satisfactory matching can be observed over the entire image data area.

As described above, the image forming apparatus according to the first embodiment uses the correlation table based on the density information (detection results obtained by the density sensor 218) in the normal print mode and the circumferential speed difference of the developing roller 303 or other such parameter. With this configuration, the lookup table in the wide color gamut print mode can be obtained without downtime. Examples of parameters to be required other than the circumferential speed difference include the degree of use of the photosensitive drum 301 and the consumption degree of the toner. In the construction of the first embodiment, the circumferential speed difference of the developing roller 303 is employed, but any parameter for controlling the toner supply amount may be employed, and the present invention is not limited to the configuration using the circumferential speed difference. When the density information is changed by other parameters, it is required to include those parameters as well. Specific examples thereof include the rotation time of the developing roller 303. This is based on a phenomenon that the surface of the toner regulating blade 308 wears due to the rubbing between the developing roller 303 and the toner regulating blade 308 to change the amount of the toner coating the surface of the developing roller 303 after regulation.

In the first embodiment, the lookup table in the wide color gamut print mode is predicted based on the detection results obtained by the density sensor 218 in the normal print mode. For example, the lookup table in the normal print mode may be predicted based on the detection results obtained by the density sensor 218 in the wide color gamut print mode.

According to the first embodiment described above, it is possible to reduce the downtime required for the hue adjustment, and to reduce the degree of losing a color balance even in another mode different in color gamut from a predetermined mode.

Second Embodiment

Figure 10:
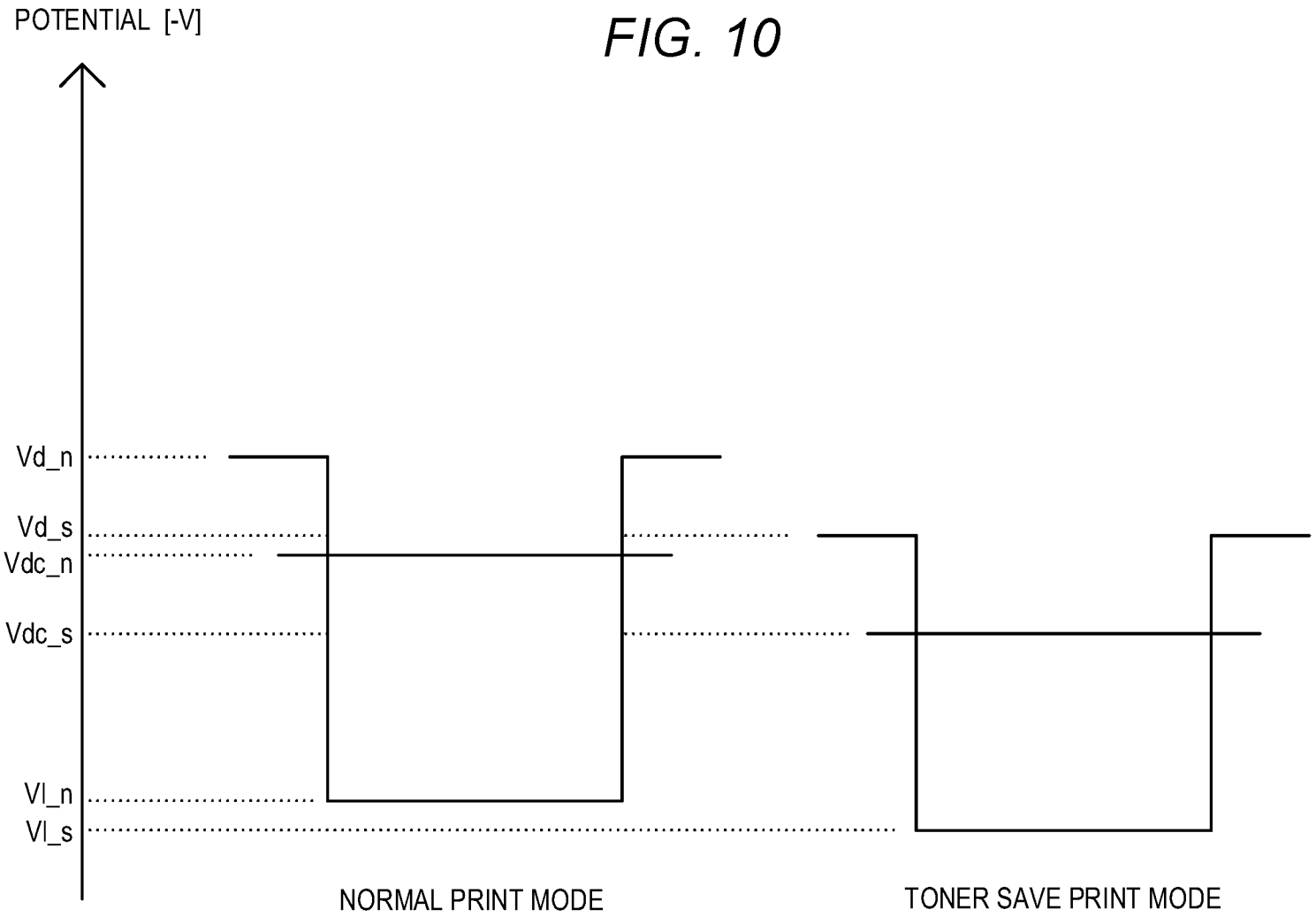
FIG. 10 is a schematic explanatory graph of a surface potential of the photosensitive drum in the second embodiment.

A second embodiment of the present invention is described by taking an example of providing a toner save print mode as a variable density image formation mode that suppresses toner consumption as compared to the normal print mode as a reference image formation mode. The second embodiment relates to an image forming apparatus capable of forming an image in the toner save print mode being the second mode using a color gamut different from the color gamut in the normal print mode being the first mode. The toner save print mode is a mode in which the consumption amount of toner is smaller than the consumption amount of the toner in the normal print mode. However, the configuration of the image forming apparatus is the same as that of the first embodiment, and hence a description thereof is omitted. The surface potential of the photosensitive drum 301 in each of the normal print mode and the toner save print mode is described with reference to FIG. 10. In FIG. 10, the vertical axis represents the potential (−V).

In the toner save print mode, the circumferential speed of the developing roller 303 is lowered so that the circumferential speed difference is reduced, and the toner amount per unit on the photosensitive drum 301 is reduced so that the toner consumption is suppressed. In addition, in the same manner as in the first embodiment, it is required to set the surface potential of the photosensitive drum 301 at the same time as the changing the circumferential speed difference. The supply amount of the toner supplied by the developing roller 303 is reduced, and hence it is required to reduce the potential contrast Vcont to a level lower than in the normal print mode on the same ground as that described in the first embodiment. In the normal print mode for a construction of the second embodiment, the circumferential speed difference of 140%, Vd_n=−500 V, Vdc_n=−350 V, and Vl_n=−100 V are employed. Meanwhile, in the toner save print mode, a circumferential speed difference of 110%, Vd_s=−380 V, Vdc_s=−250 V, and Vl_s=−50 V are employed. In this case, the charging voltage Vd, the developing potential Vdc, and the exposure potential Vl are represented by Vd_s, Vdc_s, and Vl_s, respectively, in the toner save print mode.

In the second embodiment, data required for creating the correlation table includes pieces of density data obtained in the normal print mode and the toner saving print mode for the respective circumferential speed differences in the case of using the new drum unit 310, the life-equivalent drum unit 310 exhibiting a high degree of use, the new developing unit 309, and the developing unit 309 subjected to the printing of about 3,000 recording materials 203 at the coverage rate of 5%. Similarly to the first embodiment, those pieces of density data are based on data obtained by measuring the density of the image after the fixation, which has been formed on the recording material 203, by the external measuring apparatus or the like during, for example, a development process for the image forming apparatus. In order to obtain a desired density in the image finally formed on the recording material 203, the density of the image after the fixation, which has been formed on the recording material 203, is measured by the external measuring apparatus or the like. It is therefore assumed that a table indicating a correlation between the data obtained by measuring the density of the image after the fixation and data obtained by measuring the density of an image before the fixation by the density sensor 218 is stored in advance in, for example, the storage portion (not shown) included in the controller 201.

Figure 11A:
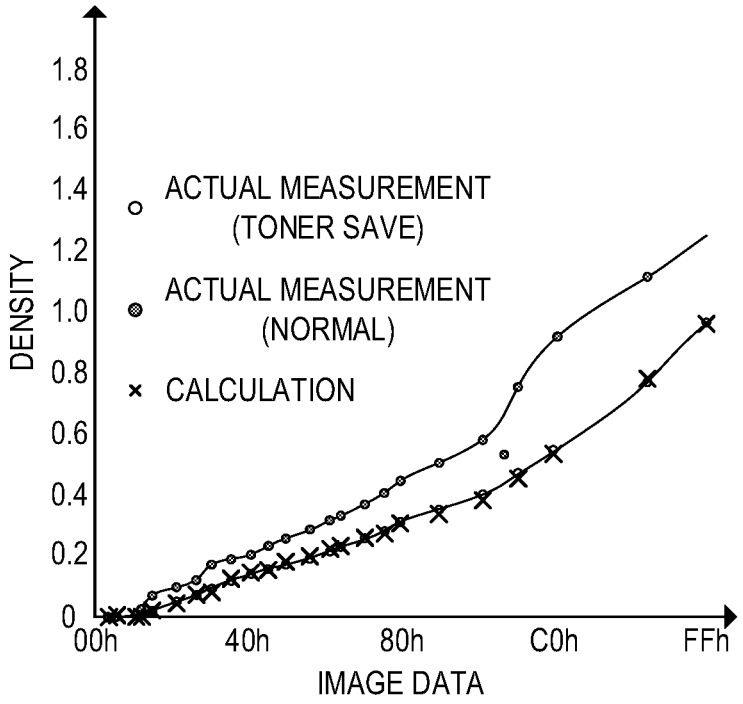
FIG. 11A is a schematic explanatory graph of a calculation accuracy for densities in a toner save print mode in the second embodiment.

FIG. 11A is a graph for showing a result of calculating the density in the toner save print mode. FIG. 11A is also a graph obtained in the case of using the developing unit 309 subjected to the printing of 3,000 recording materials 203 at the circumferential speed difference of 110% and the coverage rate of 5% and the drum unit 310D subjected to the printing of 1,000 recording materials 203 under the same condition. The horizontal axis and the vertical axis of FIG. 11A are the same as those of FIG. 7B and the like, and descriptions thereof are omitted. In FIG. 11A, the hatched circle indicates actually measured data in the normal print mode, and the symbol "○" indicates actually measured data in the toner save print mode. Also in FIG. 11A, the symbol "x" indicates data calculated by the method of the second embodiment.

Figure 11B:
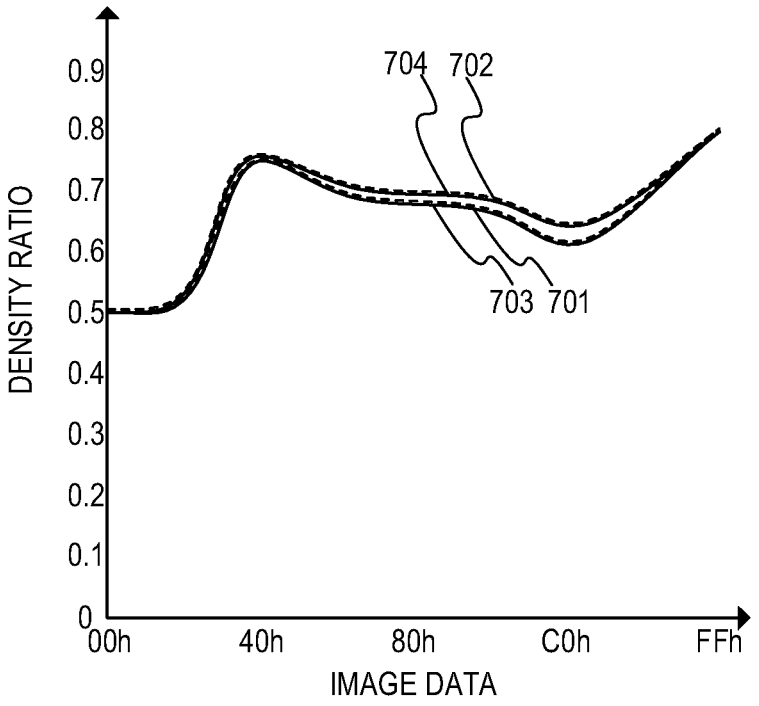
FIG. 11B is a schematic explanatory graph of density ratios between the normal print mode and the toner save print mode.

As shown in FIG. 11A, relatively satisfactory matching can be observed over the entire image data area. FIG. 11B is a graph for showing a correlation table in the second embodiment. In FIG. 11B, the horizontal axis represents the image data (gradation), and the vertical axis represents the density ratio. The correlation table in the second embodiment is a quotient obtained by dividing the density in the toner save print mode by the density in the normal print mode. In FIG. 11B, correlation tables 701, 702, 703, and 704 correspond to the correlation tables 601, 602, 603, and 604, respectively, in the first embodiment. Specifically, the correlation table 701 is a correlation table obtained in the case of using the drum unit 310A and the developing unit 309A. The correlation table 703 is a correlation table obtained in the case of using the drum unit 310A and the developing unit 309B. Meanwhile, the correlation table 702 is a correlation table for the drum unit 310C and the developing unit 309A. The correlation table 704 is a correlation table for the drum unit 310C and the developing unit 309B. In the second embodiment, the density in the toner save print mode can also be calculated based on the density in the normal print mode by a method similar to the method described in the first embodiment.

Specifically, when the density in the toner saving print mode is to be calculated, first, the current toner use amount is calculated through use of the nonvolatile memory (not shown) mounted to the process cartridge 204. From the correlation table 701 for the drum unit 310A and the developing unit 309A and the correlation table 703 for the drum unit 310A and the developing unit 309B, (1) a correlation table for the drum unit 310A and the current developing unit 309 is calculated.

In the same manner, from the correlation table 702 for the drum unit 310C and the developing unit 309A and the correlation table 704 for the drum unit 310C and the developing unit 309B, (2) a correlation table for the drum unit 310C and the current developing unit 309 is calculated. Subsequently, the use amount of the current drum unit 310 is calculated through the use of the nonvolatile memory (not shown) mounted to the process cartridge 204. Then, the following correlation table is calculated from the two correlation tables of (1) the correlation table for the drum unit 310A and the current developing unit 309 and (2) the correlation table for the drum unit 310C and the current developing unit 309. That is, the correlation table for the current drum unit 310 and the current developing unit is calculated.

In the second embodiment, the lookup table in the toner save print mode is predicted based on the detection results obtained by the density sensor 218 in the normal print mode. For example, the lookup table in the normal print mode may be predicted based on the detection results obtained by the density sensor 218 in the toner save print mode.

According to the construction of the second embodiment described above, the downtime for the hue adjustment is not required for each of the two print modes, and it is possible to obtain the lookup tables optimized for the two print modes. According to the second embodiment described above, it is possible to reduce the downtime required for the hue adjustment, and to reduce the degree of losing a color balance even in another mode different in color gamut from a predetermined mode.

Third Embodiment

Now, a construction of a third embodiment of the present invention is described. The configuration of the image forming apparatus is the same as that of the first embodiment, and a description thereof is omitted. In the construction of the third embodiment, in the same manner as in the first embodiment, the density information in the wide color gamut print mode is to be calculated from the density information in the normal print mode, and a configuration for calculating the density information for a low density portion exhibiting low accuracy from a calculation result for a high density portion is employed.

Figure 12:
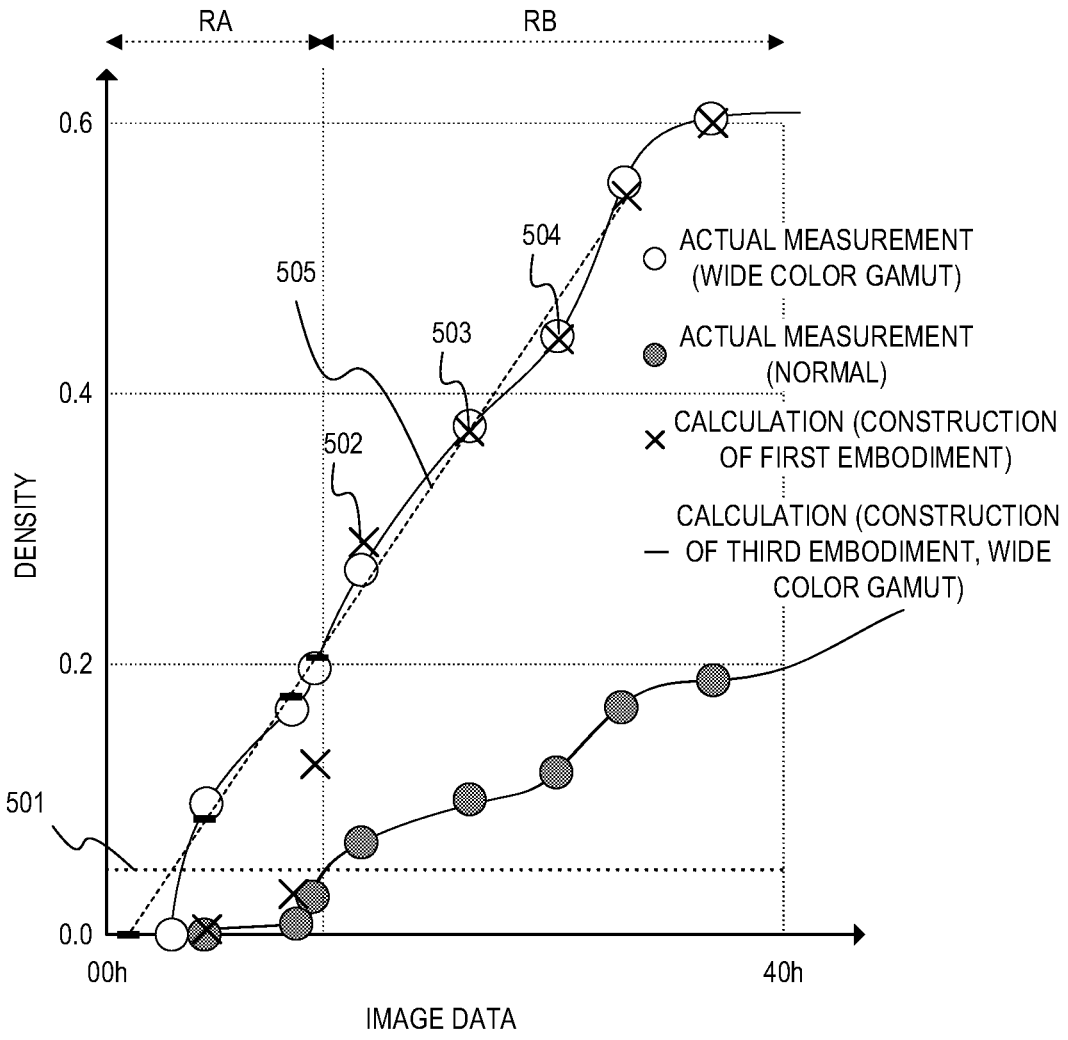
FIG. 12 is a schematic explanatory graph of the densities in a low gradation portion in the normal print mode and the wide color gamut print mode in the third embodiment.

In FIG. 12, an enlarged graph of the low gradation side (ranging from 00h to about 40h) of FIG. 9B is shown. The horizontal axis and the vertical axis of FIG. 12 are the same as those of FIG. 9B and the like, and descriptions thereof are omitted. In FIG. 12, the hatched circle indicates actually measured data in the normal print mode, and the symbol "○" indicates actually measured data in the wide color gamut print mode. Also in FIG. 12, the symbol "x" indicates data calculated by the method of the first embodiment, and the symbol "-" indicates data calculated by a method of the third embodiment.

It is understood that the accuracy of the calculation result in the first embodiment in a region RA on the low gradation side is relatively lower than in a region RB. This is ascribable to the fact that the toner has been developed in the wide color gamut print mode while the toner has not been developed in the normal print mode. Specifically, this is ascribable to the fact that the case in which the toner has not been developed in any one of the two print modes and the case in which the toner has been developed in the wide color gamut print mode while the toner has not been developed in the normal print mode cannot be distinguished from each other only by the density information in the normal print mode. Therefore, a density (predetermined density) at a boundary 501 indicated by the dotted line in FIG. 12 is set to 0.05 for the construction of the third embodiment, and for only the density higher than the boundary 501 in the normal print mode, the density in the wide color gamut print mode is calculated by the same method as that of the first embodiment. Then, calculation points 502, 503, and 504 being results of calculating densities in the wide color gamut print mode near the boundary 501 are used to obtain an approximate straight line 505. When the density in the normal print mode is equal to or smaller than the boundary 501 (equal to or lower than the predetermined density), the density in the wide color gamut print mode in the low density portion is calculated based on the approximate straight line 505. As a result, relatively satisfactory matching with the actual measurement result can be observed even in the region RA on the low density side.

As described above, according to the construction of the third embodiment, the downtime for the hue adjustment is not required for each of the two print modes, and it is possible to obtain the lookup tables optimized for the two print modes. In the construction of the third embodiment, the density in a low gradation portion is calculated from the density in a high gradation portion in the wide color gamut print mode, but the construction of the third embodiment can be applied in the same manner even when the circumferential speed is lowered as in the second embodiment. As described above, according to the third embodiment, it is possible to reduce the downtime required for the hue adjustment, and to reduce the degree of losing a color balance even in another mode different in color gamut from a predetermined mode.

The first embodiment to the third embodiment are described by taking the image forming apparatus configured to transfer the toner image formed on the photosensitive drum 301 onto the intermediate transfer belt 205. However, the present invention can be applied even to an image forming apparatus configured to cause toner images on the photosensitive drum 301 each having a single color to be sequentially transferred onto a recording material carried by a belt by being superimposed on each other, and produces the same effect.

As described above, according to the first to third embodiments described above, it is possible to reduce the downtime required for the hue adjustment, and to reduce the degree of losing a color balance even in another mode different in color gamut from a predetermined mode.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-137195, filed Jul. 13, 2017, which is hereby incorporated by reference herein in its entirety.

What is claimed is:

1. An image forming apparatus capable of performing an image forming operation based on an image forming operation condition, the image forming apparatus comprising:

a photosensitive drum;

an exposure unit configured to expose the photosensitive drum to form an electrostatic latent image on the photosensitive drum;

a developing roller configured to develop the electrostatic latent image on the photosensitive drum which has been formed by the exposure unit with toner to form a toner image on the photosensitive drum;

a belt, the toner image formed on the photosensitive drum being transferred onto the belt or a recording material carried by the belt;

a detection unit configured to detect reflected light representing a density of an image for detection formed on the belt; and a controller configured to perform adjustment of an image formation condition based on a result of detecting the reflected light representing the density of the image for detection by the detection unit, wherein the image forming apparatus is operable so as to perform image formation in a second mode using a color gamut different from a color gamut in a first mode, the image forming operation condition being different between the first mode and the second mode, and wherein the controller is configured to perform the adjustment of the image formation condition in the second mode (i) based on the result of detecting the reflected light representing the density of the image for detection by the detection unit in the first mode and (ii) a correlation of density between the first mode and the second mode.

2. The image forming apparatus according to claim 1, wherein the controller performs the adjustment of the image formation condition based on the result of detecting the reflected light representing the density of the image for detection and a parameter for controlling a supply amount of toner to be supplied from the developing roller to the photosensitive drum.

3. The image forming apparatus according to claim 1, wherein the controller is configured to obtain image data for a current photosensitive drum and a current developing roller and a density ratio between a density obtained in the first mode and a density obtained in the second mode based on data on the density obtained in each of the first mode and the second mode under a predetermined condition, a current use amount of toner, and a degree of use of the current photosensitive drum, and to perform the adjustment of the image formation condition based on a detection result obtained by the detection unit in the first mode and the density ratio.

4. The image forming apparatus according to claim 3, wherein the data on the density obtained in each of the first mode and the second mode under the predetermined condition includes:

a first density ratio between a density in the first mode and a density in the second mode which have been obtained through use of a new photosensitive drum and a new developing roller;

a second density ratio between a density in the first mode and a density in the second mode which have been obtained through use of the new photosensitive drum and a developing roller subjected to image formation on a predetermined number of recording materials;

a third density ratio between a density in the first mode and a density in the second mode which have been obtained through use of a photosensitive drum exhibiting a high degree of use and the new developing roller; and a fourth density ratio between a density in the first mode and a density in the second mode which have been obtained through use of the photosensitive drum exhibiting a high degree of use and the developing roller subjected to the image formation on the predetermined number of recording materials.

5. The image forming apparatus according to claim 3, further comprising a cartridge including the photosensitive drum, the developing roller, and a nonvolatile memory, wherein the nonvolatile memory is configured to store data on the current use amount of the toner and data on the degree of use of the current photosensitive drum.

6. The image forming apparatus according to claim 1, wherein the density becomes lower as use of the photosensitive drum progresses.

7. The image forming apparatus according to claim 1, wherein the density becomes higher as use of the developing roller progresses until a predetermined use amount of the developing roller is reached, and the density maintains a constant level after the predetermined use amount is reached.

8. The image forming apparatus according to claim 1, wherein the controller is configured to obtain the correlation for a low density equal to or lower than a predetermined density based on the correlation obtained with a density higher than the predetermined density in the second mode.

9. The image forming apparatus according to claim 1, wherein the second mode includes a wide color gamut print mode using a color gamut wider than the color gamut in the first mode.

10. The image forming apparatus according to claim 1, wherein the second mode includes a toner save print mode in which a consumption amount of toner is less than a consumption amount of toner in the first mode.

11. The image forming apparatus according to claim 1, wherein the image forming operation condition is a circumferential speed difference between a circumferential speed of the developing roller and a circumferential speed of the photosensitive drum, and wherein the circumferential speed difference in the second mode is set to be greater than the circumferential speed difference in the first mode.

12. The image forming apparatus according to claim 11, wherein the density becomes higher as the circumferential speed difference increases.

13. The image forming apparatus according to claim 1, wherein the image forming operation condition is a potential contrast between a developing voltage and an exposure potential of the photosensitive drum formed by exposure by the exposure unit, and wherein the potential contrast in the second mode is set to be greater than the potential contrast in the first mode.

14. The image forming apparatus according to claim 1, wherein a target density for image data in the second mode is different from a target density for the image data in the first mode.

* * * * *